United States Patent [19]

Yacoboski

[11] Patent Number: 5,050,863

[45] Date of Patent: Sep. 24, 1991

[54] EXERCISE CHAIR FOR USE IN SWIMMING POOL

[76] Inventor: Anton Yacoboski, 3070 Kerner Blvd., Ste. S, San Rafael, Calif. 94901

[21] Appl. No.: 380,583

[22] Filed: Jul. 17, 1989

[51] Int. Cl.[5] ..... A63B 31/00

[52] U.S. Cl. ..... 272/71; 272/144

[58] Field of Search ..... 272/70, 71, 144, 900, 272/62, 116, 134; 108/47; 4/573, 574, 575; 5/81 R, 83, 84

[56] References Cited

U.S. PATENT DOCUMENTS

| | | | |
|---|---|---|---|
| 3,071,410 | 1/1963 | Gaskin | 272/71 |
| 3,112,928 | 12/1963 | Oswald | 272/71 |
| 4,197,839 | 4/1980 | Lay | 272/144 X |
| 4,218,056 | 7/1990 | Whitling | 272/71 |
| 4,247,096 | 1/1981 | Schmitt | 272/71 |
| 4,549,733 | 10/1985 | Salyer | 272/144 X |
| 4,674,740 | 6/1987 | Iams et al. | 272/71 |
| 4,739,984 | 4/1988 | Dranselka | 272/900 X |
| 4,850,282 | 7/1989 | Postic | 108/47 |
| 4,875,673 | 10/1989 | Erickson | 272/71 |

FOREIGN PATENT DOCUMENTS

| | | | |
|---|---|---|---|
| 3600061 | 7/1987 | Fed. Rep. of Germany | 272/71 |

*Primary Examiner*—Richard J. Apley
*Assistant Examiner*—Jerome W. Donnelly
*Attorney, Agent, or Firm*—Flehr, Hohbach, Test, Albritton & Herbert

[57] ABSTRACT

The disclosure is of a support chair to enable a person to perform arm and leg exercise in a swimming pool. The upper horizontal beam of a C-shaped frame is secured to the deck adjacent the pool and the lower arm engages the side wall of the pool to be supported thereby. A seat with back support is slidably carried to the support frame for adjustment of the depth of the seat in the pool. One of the horizontal beams of the frame is of adjustable length to adjust the angle of the seat.

8 Claims, 1 Drawing Sheet

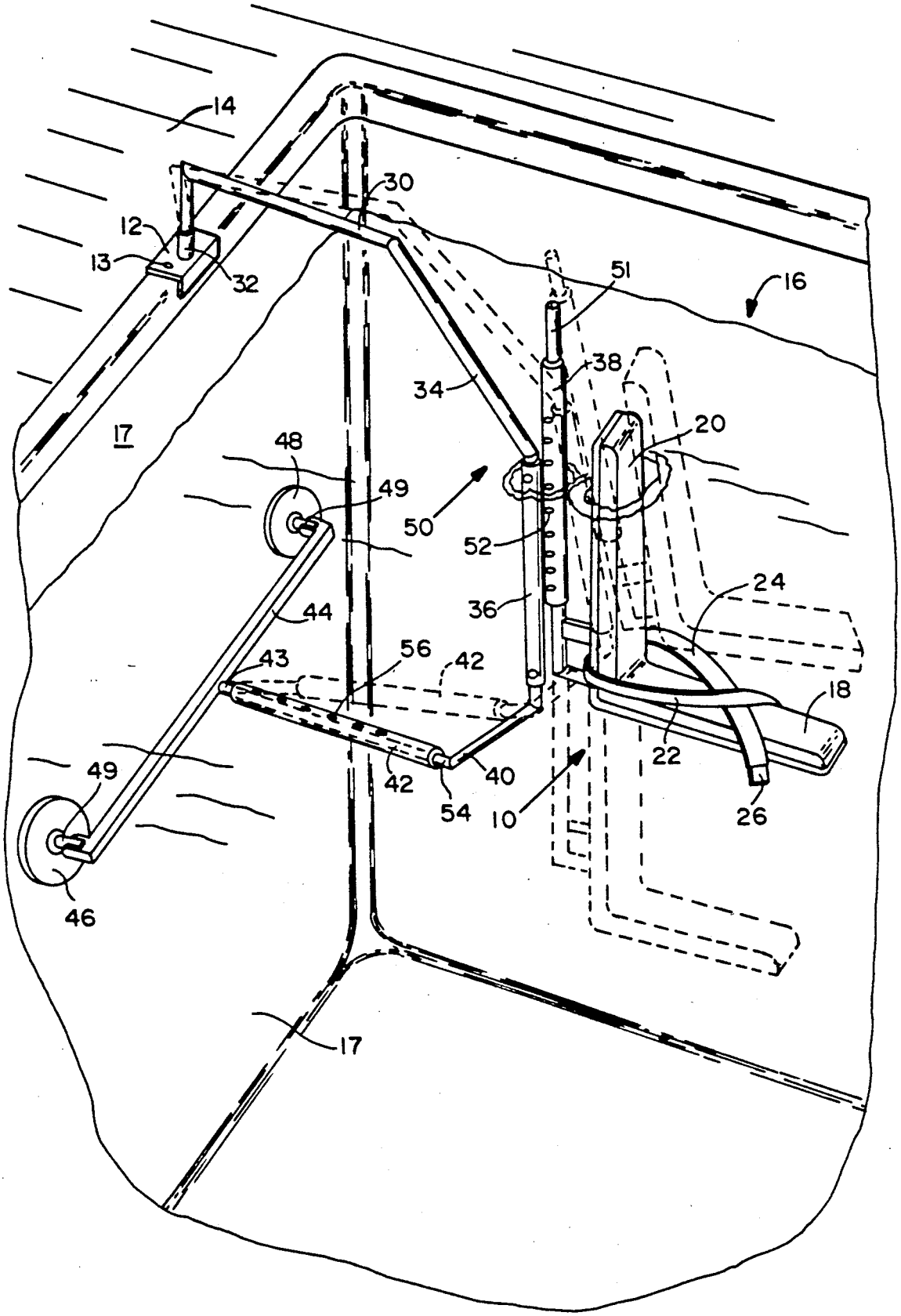
14
30
12
13
32
51
16
38
34
20
17
48
49
50
52
24
44
36
43
56
42
18
22
49
42
40
54
10
26
46
17

EXERCISE CHAIR FOR USE IN SWIMMING POOL

BACKGROUND OF THE INVENTION

A number of exercising devices have been developed for exercising the arms, legs and various muscle of the human body while submerged in a body of water, such as a swimming pool. In a previous exercise of my own invention, shown in U.S. Pat. No. 4,480,829 for "Aquatic Exercising and Body Toning Device", a person could exercise and strengthen the muscles of his arms and upper body by moving the device through the water while standing on the bottom of a swimming pool, such movements being resisted by the water itself. However, exercises involving movement of the arms and/or legs while in the water, tend to propel a person through the water or require him to hold onto something in order to avoid being so propelled. If a person is so propelled, it is difficult for an instructor or trainer to maintain close supervision. If, on the other hand, the exerciser has to hold against movement he cannot have both arms and legs free for movement. It would be desirable, in some instances, to allow a person to be supported in a swimming pool at a selected depth, but with his or her head above water while exercising his arms and/or legs against resistance of the water, without being propelled through the water.

OBJECTS OF THE INVENTION

It is an object of this invention to provide a device for supporting a person submerged in a swimming pool while enabling him to move his arms and legs freely against resistance of the water.

It is a further object of this invention to provide a chair for supporting a person in a swimming pool for exercising arms and legs at a selected depth.

It is a further object of this invention to provide a chair for supporting a person at least partially submerged and at a selected angle.

Other objects and advantages of this invention will become apparent from the description to follow, particularly when read in conjunction with the accompanying drawings.

SUMMARY OF THE INVENTION

In carrying out this invention, I provide a generally C-shaped frame, the upper arm or beam of which is supported and anchored onto the deck adjacent a swimming pool. The lower arm is supported against the side wall of the pool. An upright section between the upper and lower arms forms an upright post that is slidably engaged by an upright post carrying a set with back support. The seat-carrying post, therefore, can be positioned at selected depth. In one form, the seat is quite narrow so that a person can straddle it while being supported thereon and strapped in place. Hence, the person can freely exercise his arms and legs while being held against movement through the water. Means are also provided for adjusting the angle of the seat so that the person can be held with his back generally vertical or leaning back at a slight angle.

BRIEF DESCRIPTION OF THE DRAWING

In the drawing:

FIG. 1 is a view in perspective showing the exercise support chair in position in a swimming pool.

DESCRIPTION OF PREFERRED EMBODIMENT

Referring now to the drawing with greater particularity, the exercise chair 10 of this invention includes a top anchor device 12 which is secured by any suitable means such as screws 13, to the deck 14 around a swimming pool 16.

The exercise chair 10 includes a narrow seat 18 with integral back rest or support 20 to support a person in the swimming pool 16. A pair of seat belts or straps 22 and 24, having suitable fastening means 26 such as "VELCRO " hook and loop fasteners are provided to hold the exerciser in place. The seat 18 is preferably narrow enough to enable the exerciser to straddle it and move his or her legs freely from the hips. Similarly the back support 20 is relatively narrow so that it does not impede movement of the arms. Moreover, the straps 22 and 24 hold the person in place on the support seat so that the arm and leg movement do not propel him away. All of the movements are expended in worthwhile exercise, and the exerciser, being in place, is more easily supervised.

The exercise chair 10 is supported on an upper, generally horizontal, support beam 30, which is pivoted at 32 to the top anchor 12 for adjustment of the angle of the set 10 as will hereinafter be described.

The top support beam is bent down at an angle 34 to extend toward the surface of the pool 16 and then vertically downward to form an upright back support post 36, to which is secured a parallel, depth adjustment sleeve 38. The back support post then extends downwardly and rearwardly at 40 to be received in and secured to a horizontal seat angle adjustment sleeve 42. The seat angle adjustment sleeve 42 slidably receives the leg 43 of a T-shaped bottom anchor beam 44. A pair of suction cups 46 and 48 are pivoted at 49 to the opposite ends of the arms 44. In the alternative, pads could be substituted for the support suction cups 46 and 48 to support the C-shaped frame 50 under force of gravity, without marring or damaging the side walls 17 of the pool 16.

In installation, the top anchor 12 is attached in place and the lower horizontal beam 42 is allowed to pivot down by gravity to engage the side wall 17 of the pool 16. Then the chair 10 is lowered to a desired depth in the pool by sliding the seat support post 51 in the depth adjustment sleeve 38. At the desired depth, a pin 52 may be inserted to engage aligned holes in the seat support post 51 and the depth adjustment sleeve 38. The seat angle adjustment sleeve 42 may be pulled forward on the leg 43 of the T-beam 44 to position the seat 18, 20 at the desired angle for the intended exercise. At the selected angle a pin may be inserted through aligned openings 56 in the rod 43 and sleeve 42. This sets the seat 10 at the desired angle and the bottom anchor T-beam 44 is pivoted about the pins 49 to adapt to the angle. The exerciser can mount and straddle the seat 18 and strap himself in place by securing the belts 22 and 24.

With the narrow seat, the patient is free to move both legs from the hips in desired leg exercises and swing his arms and shoulders, as required for arm and upper body exercises. Of course, for may exercises it may be preferred to substitute a chair 10 with wider seat and/or back support.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as invention is:

1. A chair for supporting a person while performing underwater physical arm and leg exercises in a swimming pool comprising:

a generally C-shaped support frame having a generally horizontal upper beam, a generally horizontal lower beam and an interconnecting upright post;

means for adjusting the angle of said upright post to the vertical;

means for anchoring the distal end of said upper beam to a stationary structure adjacent a swimming pool;

a means on the distal end of said lower beam adapted to engage the side wall of said swimming pool below the surface of water therein without damaging the surface of the said side wall;

a narrow seat carried on and extending from said upright post to support a person astride it while enabling the free movement of said person's legs from the hips; and an upright narrow back rest secured to said seat to engage said person's back just along the spine to enable simultaneous free underwater movement of the shoulders and arms and means fixing said back rest generally parallel to said upright post; and strap means carried on at least one of said seat and back rest to engage around said person's mid-section to hold said person on said seat without impeding said arm and leg movements.

2. The support chair defined by claim 1 including:

means for adjusting the elevation of said seat on said upright post.

3. The support chair defined by claim 1 including: an upright sleeve carried on said seat and back rest and slidably received on said upright post, and lock means securing said sleeve in fixed position on said upright post.

4. The support chair defined by claim 1 wherein:

said lower beam is of a generally Tee configuration with the cross bar of said Tee adapted to be disposed horizontally along said side wall of the swimming pool; and resilient means on the ends of said cross bar to engage said side wall.

5. The support chair defined by claim 4 wherein:

said resilient means are suction cups.

6. A device for supporting a person while performing underwater body, arm and leg exercises in a swimming pool comprising:

a narrow chair with approximately perpendicular bottom and back supports;

said bottom support being adapted to support the buttocks of a person astride it without impeding free leg movements from the hip;

said back support being adapted to engage along said person's spine without impeding shoulder and arm movements;

strap means attached to said chair to engage around said person's mid-section to hold said person in place while enabling said arm and leg movement simultaneously;

means adapted to hold said chair in position fully submerged in said swimming pool; and means to adjust the backward tilt of said chair.

7. A chair for supporting a person while performing physical exercises in a swimming pool comprising:

a post;

means for supporting said post in a pool in a substantially vertical plane perpendicular to a wall of said pool and spaced inward therefrom;

a chair with substantially perpendicular bottom and back supports;

an upright member secured to the back of said chair and slideably engaged on said posts;

mutually engageable means on said upright member and said post to fix said chair in a selected elevation; and strap means carried on said chair to engage around said person's mid-section to hold said person on said chair without impeding arm and leg movements.

8. The support chair defined by claim 1 including:

means for adjusting the angle of said post to the vertical.

* * * * *